United States Patent [19]

Lakic

[11] Patent Number: 4,845,338

[45] Date of Patent: Jul. 4, 1989

[54] INFLATABLE BOOT LINER WITH ELECTRICAL GENERATOR AND HEATER

[76] Inventor: Nikola Lakic, 73-355 Guadalupe Ave. Unit M, Palm Desert, Calif. 92260

[21] Appl. No.: 177,410

[22] Filed: Apr. 4, 1988

[51] Int. Cl.[4] ..... A43B 5/04; A43B 7/04

[52] U.S. Cl. ..... 219/211; 219/527; 36/2.6; 36/117

[58] Field of Search ..... 219/211, 527; 36/2.6, 36/3 R, 3 A, 3 B, 117

[56] References Cited

U.S. PATENT DOCUMENTS

| | | | |
|---|---|---|---|
| 1,213,941 | 1/1917 | Patrick | 36/3 R |
| 1,335,273 | 3/1920 | Bruce | 36/3 A |
| 2,716,293 | 8/1955 | Rath | 36/3 A |
| 3,000,616 | 9/1961 | Spangler | 36/2.6 |
| 3,029,530 | 4/1962 | Eaton | 36/3 R |
| 3,180,039 | 4/1965 | Burn | 36/3 B |
| 3,663,796 | 5/1972 | Hines et al. | 219/211 |
| 4,154,009 | 5/1979 | Kubelka et al. | 36/119 |
| 4,507,877 | 4/1985 | Vaccari et al. | 36/2.6 |
| 4,615,127 | 10/1986 | Delery | 36/117 |
| 4,665,308 | 5/1987 | Courvoisier et al. | 219/548 |
| 4,697,359 | 10/1987 | Balbinot | 36/2.6 |
| 4,702,022 | 10/1987 | Porcher | 36/119 |
| 4,730,403 | 3/1988 | Walkhoff | 36/119 |

FOREIGN PATENT DOCUMENTS

| | | | |
|---|---|---|---|
| 2321817 | 11/1973 | Fed. Rep. of Germany | 36/3 R |
| 3144207 | 5/1983 | Fed. Rep. of Germany | 36/3 R |
| 1223883 | 4/1986 | U.S.S.R. . | |
| 357391 | 9/1931 | United Kingdom | 36/3 A |
| 2107853 | 5/1983 | United Kingdom . | |
| 2189679 | 11/1987 | United Kingdom | 36/3 B |

*Primary Examiner*—Teresa J. Walberg

*Attorney, Agent, or Firm*—Plante Strauss Vanderburgh

[57] ABSTRACT

An inner shoe for a boot such as a ski boot includes a foot warmer mechanism having an air system that includes an air bag which surrounds its instep area and communicates to a sealed chamber between the soles of the shoe. The air bag can be pressured to maintain a sense of tightness or security to the ski boot. The air circulation system also augments heat transfer within the boot. The foot warmer mechanism is mounted entirely on an insert for the outer boot or shoe, and includes an electrical resistance heater, an electrical generator, a mechanical transducer to translate vertical movements of the wearer's heel into uni-directional rotational movement of a flywheel, and a gear box mechanically coupling the flywheel to the electrical generator. Specific features of the invention include an air pump to supply air pressure to an air chamber, including an air bag which extends over the instep of the shoe to control the snugness of the shoe; and communicating channels within the shoe to direct air across the electrical generator and heater and to the air bag, thereby warming the entire foot of the wearer. Further embodiments include tubing to direct warmed air to a suit having an inflated lining to warm the suit.

24 Claims, 9 Drawing Sheets

INFLATABLE BOOT LINER WITH ELECTRICAL GENERATOR AND HEATER

BACKGROUND OF THE INVENTION

1. The Field of the Invention

This invention relates to a warming device for shoes and boots, and in particular to a simple device for generating electricity within a shoe or boot which can be used to heat the shoe or power a radio transmitter.

2. Brief Statement of the Prior Art

U.S. Pat. No. 3,534,391 discloses an electrical generator which is mounted on the outside of a ski boot which is driven from a tether that is connected between the generator and a ski. The generated current is passed through heating elements located in the ski boot. The external mounting and tether render this device quite cumbersome and difficult to use.

French Pat. Nos. 701,420 and 2365-973 and U.S. Pat. No. 3,977,093 disclose shoes with batteries mounted in the heels, and with electric resistance heaters in the soles of the shoes. Batteries require frequent replacement, and are particularly inefficient in a cold environment.

U.S. Pat. No. 1,506,282 discloses an electric generator mounted in a telescoping heel of a shoe which generates electricity for an electric lamp, heating coil, wireless outfit or a therapeutic appliance. A telescoping heel of this design would be very difficult to seal against water and mud, and the patented device would most likely be limited to indoor applications.

U.S. Pat. Nos. 2,442,026 and 1,272,931 disclose air pumps which are located in the heels of shoes and operated during walking. In the first mentioned patent, alcohol vapors are mixed with the air stream and passed over a catalyst to generate heat. This system is cumbersome and difficult to use, and it requires replenishing the alcohol. Also, the heater elements are open in the shoe for air and gas circulation. In U.S. Pat. No. 1,272,931, the air is forced through constricted passageways to generate heat by compression. The heated air is openly discharged into the shoe, as there is no provision for a closed loop air path.

U.S. Pat. No. 382,681 discloses an armature which is mounted in a heel and manually rotated to generate heat by friction, which is dissipated in the shoe by metal conductors. U.S. Pat. No. 3,493,986 discloses an inner sole for a shoe which is formed of piezelectric or magnetostrictive material which generate heat while the user walks.

U.S. Pat. No. 2,475,092 discloses a bouncing skate having spring coils on the bottom of its sole. German Pat. Nos. 180866 and 620,963, and U.K. Pat. No. 443,571 disclose springs mounted within a shoe for orthopedic purposes. None of these patents disclose shoe heaters.

U.S. Pat. No. 4,507,877 discloses a heater for a ski boot which is mounted on the inner shoe of the boot and which includes rechargeable storage batteries, control switch and electrical heating coil. Products of this design have been marketed with chargeable and with nonrechargeable batteries. These units do not provide any sustained heating, but are useful only to provide monetary heating because of the limited storage capacity of small batteries and the low efficiencies which they experience at sub-freezing temperatures.

All of the aforementioned attempts have failed to provide a practical self sustaining heater within a shoe which harnesses the movement between the wearer's heel and the heel of the shoe to generate heat. This relative movement can be sufficient, particularly when the wearer's weight is applied, to generate the necessary heat, provided a practical heat generator can be installed within the narrow confines of the shoe and heel, without significantly affecting its external appearance and comfort.

Air bags have been positioned in ski boots, over the instep and forefoot, and have been provided with inflation pumps to provide a variable control on the snugness of fit of the boots. U.S. Pat. No. 4,420,893 discloses an air pump which is operated by the flexing of the ankle during normal skiing actions to circulate fresh air through a ski boot. While this may be useful to reduce the humidity within a boot, it would not be suitable in very cold weather.

BRIEF DESCRIPTION OF THE INVENTION

This invention comprises a system to control the pressure and circulation of air through a shoe, and particularly to circulate air across a foot warmer mechanism which is also contained within the shoe. The invention is particularly adapted for a ski boot, however it can be used with any shoe or boot. The foot warmer mechanism is mounted entirely on an insert for the outer boot or shoe, and includes an electrical resistance heater, an electrical generator, a mechanical transducer to translate vertical movements of the wearer's heel into uni-directional rotational movement of a flywheel, and a gear box mechanically coupling the flywheel to the electrical generator. Specific features of the invention include an air pump to supply air pressure to an air chamber, an air bag which extends over the instep of the shoe to control the snugness of the hoe; and communicating channels within the shoe between the air bag and chamber to direct air across the electrical generator and heater and to the air bag, thereby warming the entire foot of the wearer. As an optional feature, the shoe is provided with tubing connectors to permit the air to be pumped to a suit or clothing. In this manner, the wearer's suit can be inflated and warmed with the warm air pumped from the shoes. Other optional features include a rechargeable storage battery and a radio transmitter for generating a signal useful for locating the wearer.

BRIEF DESCRIPTION OF THE DRAWINGS

The invention will be described with reference to the FIGURES, of which.

DESCRIPTION OF PREFERRED EMBODIMENT

Figure 1:
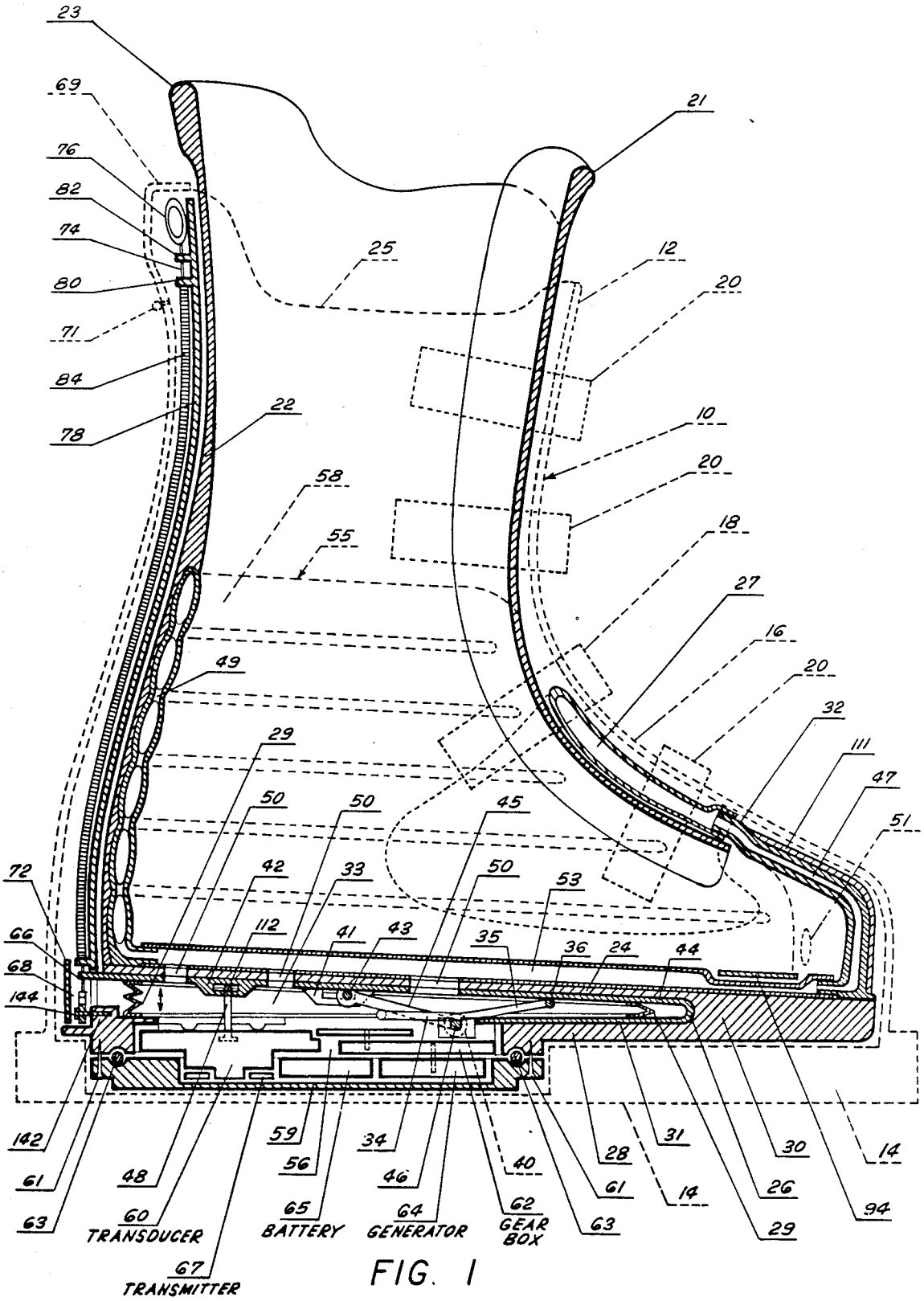
FIG. 1 is an elevational sectional view of a ski boot fitted with the foot warmer invention.

Referring now to FIG. 1, the invention is shown as applied to the inner shoe of an outwardly appearing, conventional ski boot 10. Although the invention is shown as applied to a ski boot, it could also be applied to any conventional boot or shoe of similar construction. The ski boot 10 is shown in phantom lines and comprises a molded plastic shell 12 with a molded outer sole 14 and a plastic molded upper portion 16. The upper portion 16 can be spread or opened to permit moving the boot on and off the wearer's foot and has a plurality of fastening buckles 18 and 20 to secure the upper portion 16 in a snug conforming fit about the wearer's ankle and foot. Some of the fastener buckles, particularly buckles 18 which are over the instep are provided with adjustment for controlled variation of their tension, thereby providing control over the relative degree of movement of the foot within the boot 10. Alternative and conventional tension adjustments could be used, e.g., cables can be extended over the instep and provided with tensioning adjustments. Also, the boot can open on its rear side rather than along the front side to permit insertion and removal of the inner shoe 22.

In the conventional outer ski boot 10, the outer sole 14 is hollow form with reinforcing ribbing (not shown) which extends longitudinally and transversely across the outer sole 14, subdividing its hollow interior into a number of recesses or compartments. In the application of my invention to this boot, this ribbing is reduced in height, or eliminated entirely, to provide an open hollow interior to house the foot warmer mechanism.

The inner shoe 22 for the ski boot 10 is shown in elevational cross sectional view and comprises a snug fitting sock having an upper neck 23 which extends above the upper edge 25 of the upper portion of the ski boot 10, an integral tongue 21, and an integral lower sole 28. The inner shoe also supports an air bag 27 which surrounds the upper instep of the shoe and which is contained within the boot 10.

The inner shoe 22 is molded with a lower sole 28 and an inner sole 24 which are integrally attached at the toe and are vertically spread apart at the heel. Preferably the upper and lower soles are molded together of the same plastic, thereby providing an integral hinge 30 at the toe of the inner shoe 22. The inner sole 24 is resiliently biased upwardly by spring arms 34 and 35 which project rearwardly and forwardly, respectively, from coil spring 40. Preferably, a steel leaf spring 26 is also seated between the inner sole 24 and the lower sole 28. The leaf spring 26 has an upper plate 44 which bears against the undersurface of inner sole 24 and has at least one lower return plate 31 which bears against the lower sole 28, thereby providing the necessary stiffness to the inner sole 24, and assisting the spring bias of spring arms 34 and 35. Brackets 41 are mounted at opposite sides on the undersurface of plate 44 and have slots which slidably receive shaft 43. Arms 45 extend between this shaft and shaft 46 which is received within the coil spring 40. The ends of spring arms 34 are bent laterally outwardly and are resiliently biased against the lower edges of arms 45. This provides a resilient bias to the arms, and stabilizes plate 24 against tilting, side to side.

The cavity 33 between the lower sole 28 and inner sole 24 is sealed by a membrane 29 which is formed into a bellows configuration. The interior of the boot is thus provided with two air chambers, that contained within the air bag 27, and within the sealed cavity 33 between the inner sole 24 and lower sole 28.

The inner shoe 22 is preferably lined with an inflatable, tubular lining 55 which has a plurality of internal air circulation tubes 58 along the inside upper surfaces of the shoe. These tubes 58 are in open communication through ports 49 at the heel of the inner shoe 22. The tubular lining 55 also extends across the top of the inner sole 24 with tubes 53 which extend along the length of the inner sole 24. The tubes 58 along the sides of the inner shoe communicate through a collector 47 with the tubes 53 which extend along the inner sole 24. The tubes 53 communicate with a collector 47 at the toe end of the shoe (see also FIGS. 17 and 18) and the collector 47 is in open communication with air bag 27 through connectors 32. The air tubes 53 are also in communication with cavity 33 through apertures 50 in plate 24, at the heel of the shoe. The tubular lining and air bag can be inflated to a pressure which provides an adjustment to the fit and comfort of the shoe and boot.

The footwarmer of the invention is applied to the inner shoe 22 by molding compartments 56 in the lower sole 28 of the inner shoe 22 to receive the major components of the electrical generating mechanism. These compartments are received within the hollow interior of the outer sole 14 of the ski boot 10. Preferably, compartment 56 is closed by a removable cover 59 which is secured by fastening screws 61. Most preferably, the compartment 56 is sealed by O-ring 63 which seats in a peripheral groove that extends around the compartment. Located within compartment 56 are: the mechanical transducer 60, the gear box 62, the electrical generator 64, and a rechargeable electrical storage battery 65. The aforementioned major components are located at the heel and instep of the inner shoe 22 in the aforementioned molded compartments 56.

The inner sole 24 has a bracket 42 on its undersurface, centrally located in the heel area, which receives the upper end of post 48 which is mounted for sliding, reciprocal movement in the transducer 60 which translates reciprocating vertical motion of the post 48 to unidirectional rotation of a horizontal flywheel within the mechanical transducer.

At the heel end, the plate 44 on the inner sole 24 has a distal tab 66 which projects into a brake compartment 68 formed as a pocket behind the heel of the inner shoe 22. The lower sole 28 has a raised integral block 142 at its heel end, which receives a machine screw fastener 144 for pivotal attachment of the brake latch, described in greater detail with reference to FIGS. 12–15. The brake pocket 68 is covered by vertical plate 72. An actuator cable 74 extends from the brake compartment 68 to the upper portion of the inner shoe 22 and is provided with a suitable handle, ring 76, to actuate the brake of the mechanism. As hereinafter described, the brake is functional to provide a releasable locking of the inner sole 24 against vertical displacement, thereby providing for engagement and disengagement of the heat engine.

Preferably, the outer boot 10 has a cover 69 at its upper rear, which is secured to the boot by hinge 71 to permit it to be closed over the controls, such as ring 76, or swung away to permit access to these controls.

Figures 2, 3:
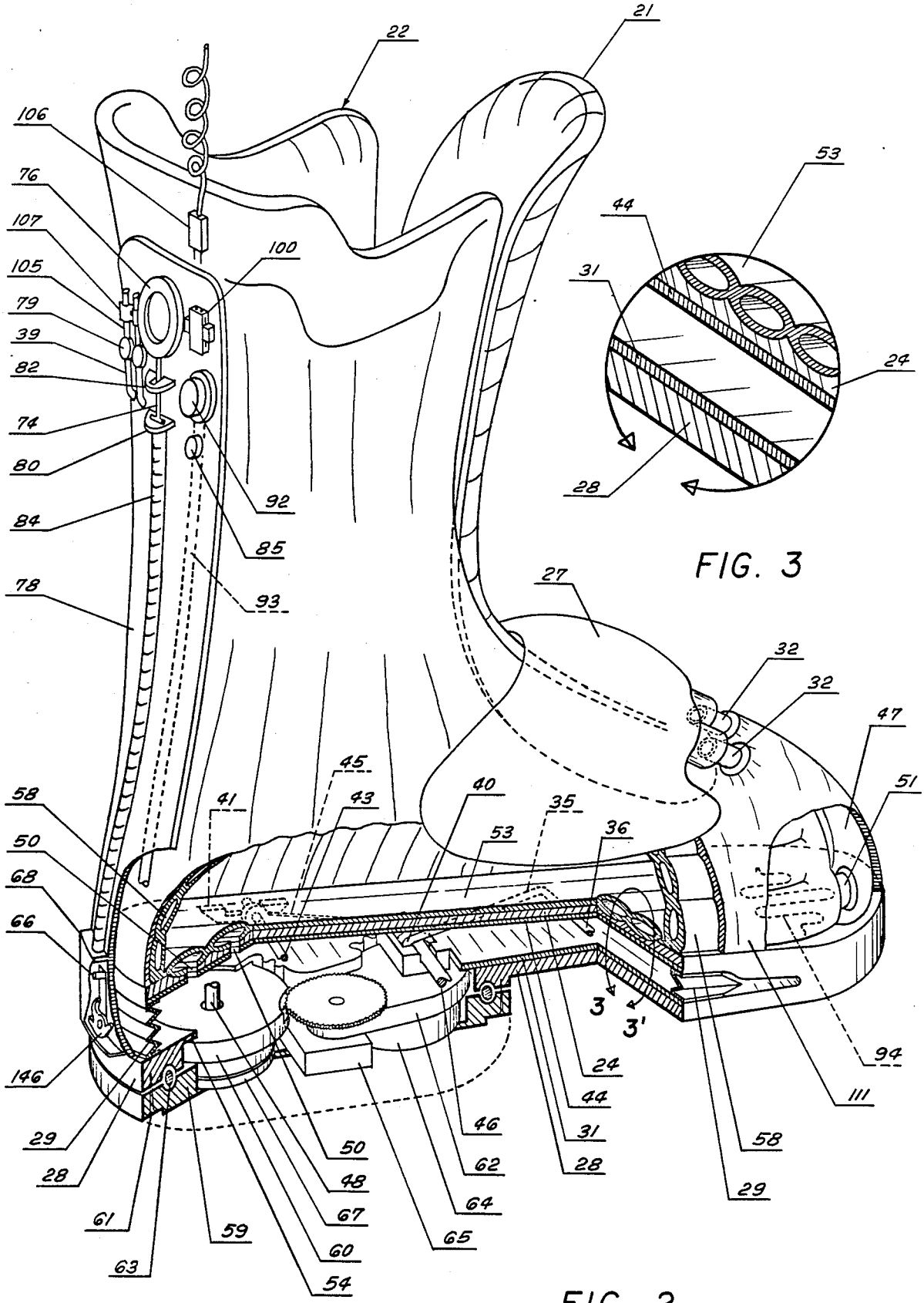
FIG. 2 is a perspective view, in partial cross-section, of the inner shoe of the boot of FIG. 1.
FIG. 3 is an enlarged view of the area within the line 3-3' of FIG. 2.
Figure 12:
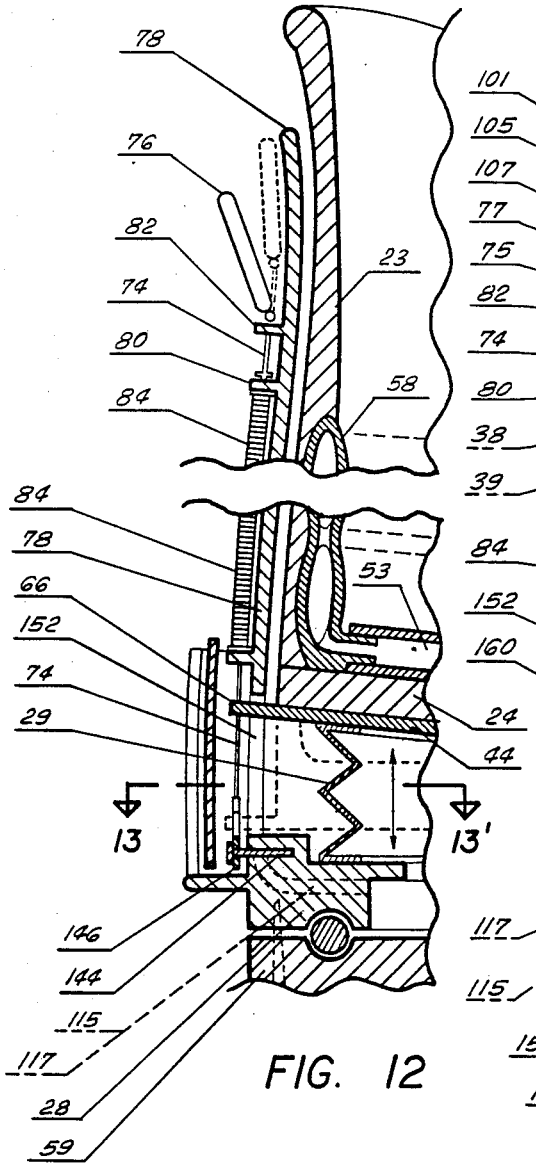
FIG. 12 is an elevational sectional view of the brake mechanism along line 12-12' of FIG. 13.
Figure 14:
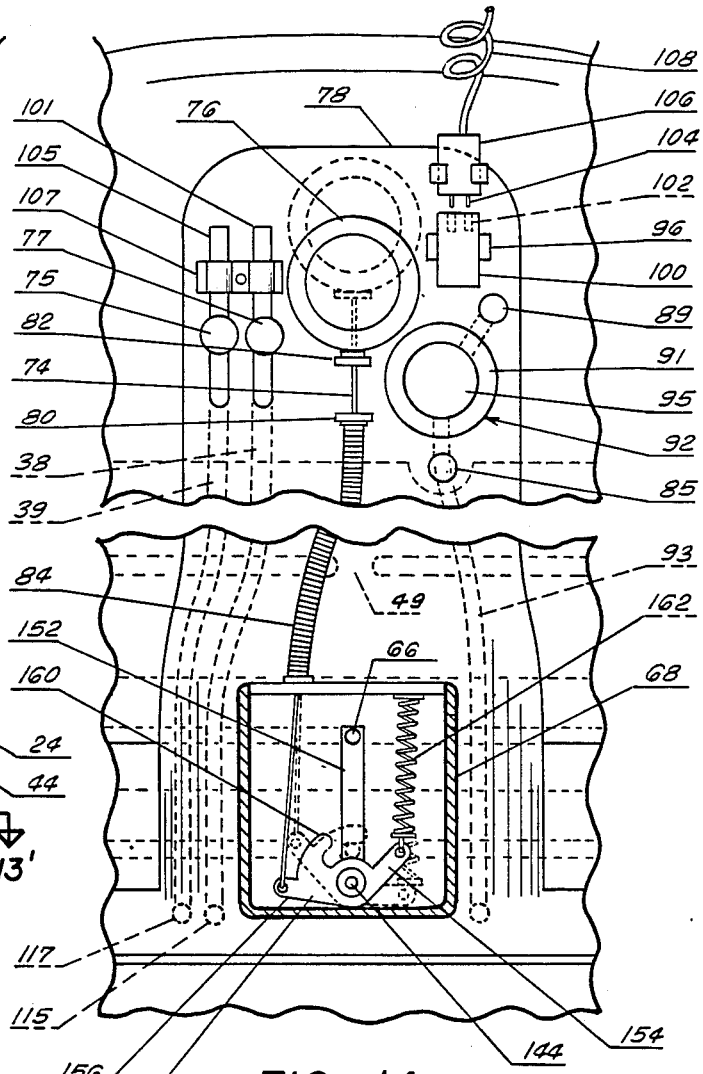
FIG. 14 is a rear view of the brake mechanism along line 14-14' of FIG. 13.
Figure 13:
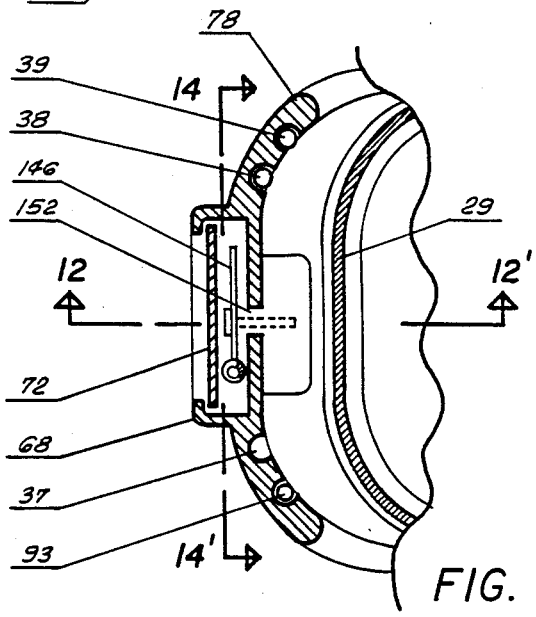
FIG. 13 is a view along line 13-13' of FIG. 12.

Referring now to FIG. 2, the inner shoe is shown in a perspective view. A portion of the side of the inner shoe 22 is cut away to permit viewing into the confined space between the inner sole 24 and lower sole 28. The inner shoe 22 is formed of a molded, compressible plastic foam which is integrally sealed to a stiff plate which forms the inner sole 24. As previously mentioned, this is a metal plate 44 that is part of a leaf spring 26. The lower sole 28 is integrally attached to the inner sole 24 at its toe end and is coextensive with the length and width of the inner sole 24. At its heel end, the lower sole 28 supports a stiff or rigid vertical tab 78 that is formed as an integral molding of the lower sole 28. The tab 78 has brackets 80 and 82 at its upper end to receive the cable 74 which terminates in the pull ring 76 and which extends downwardly through a protective, flexible conduit 84 to the brake compartment 68. The lower sole 28 also distally supports the brake compartment 68 which is formed as an integrally molded pocket at its heel end with a removable vertical plate 72 that is slidably received (as shown in FIGS. 12–14) in the pocket to protect the moveable elements of the brake to prevent interference with the inner surfaces of the outer boot 10 that would obstruct free movement of these elements. The air bag 27 extends laterally across the instep of the inner shoe from side to side and communicates with the tubes 53 and 58 in the inflatable lining 55 through tubing connectors such as 32 which communicate between the air bag 27 and the collector 47.

The interior cavity 33 of the inner shoe 22 between inner sole 24 and lower sole 28 is open to compartment 56 which houses the footwarmer mechanisms, to permit air circulation about these mechanisms. Cavity 33 is in communication with the inflatable lining 55 through one or more apertures 50 in the walls of tubes 53.

The forwardly projecting spring arm 35 which resilient urges the upper sole 24 and lower sole 28 apart also appears in partial sectional view in FIG. 2. The coils of the torsion spring 40 are mounted in laterally disposed pockets such as 90 (see FIG. 2), which are molded into the lower sole 28.

Referring now to FIG. 3, the structure of the inner sole 24 and lower sole 28 is shown in greater detail. As previously mentioned, a leaf spring 26 is mounted between these soles. This leaf spring has an upper plate 44 and lower return plate 31, which are preferably adhesively bonded to these soles. The inflatable lining 55 extends across the upper surface of the inner sole 24 with inflated air tubes 53.

Figure 4:
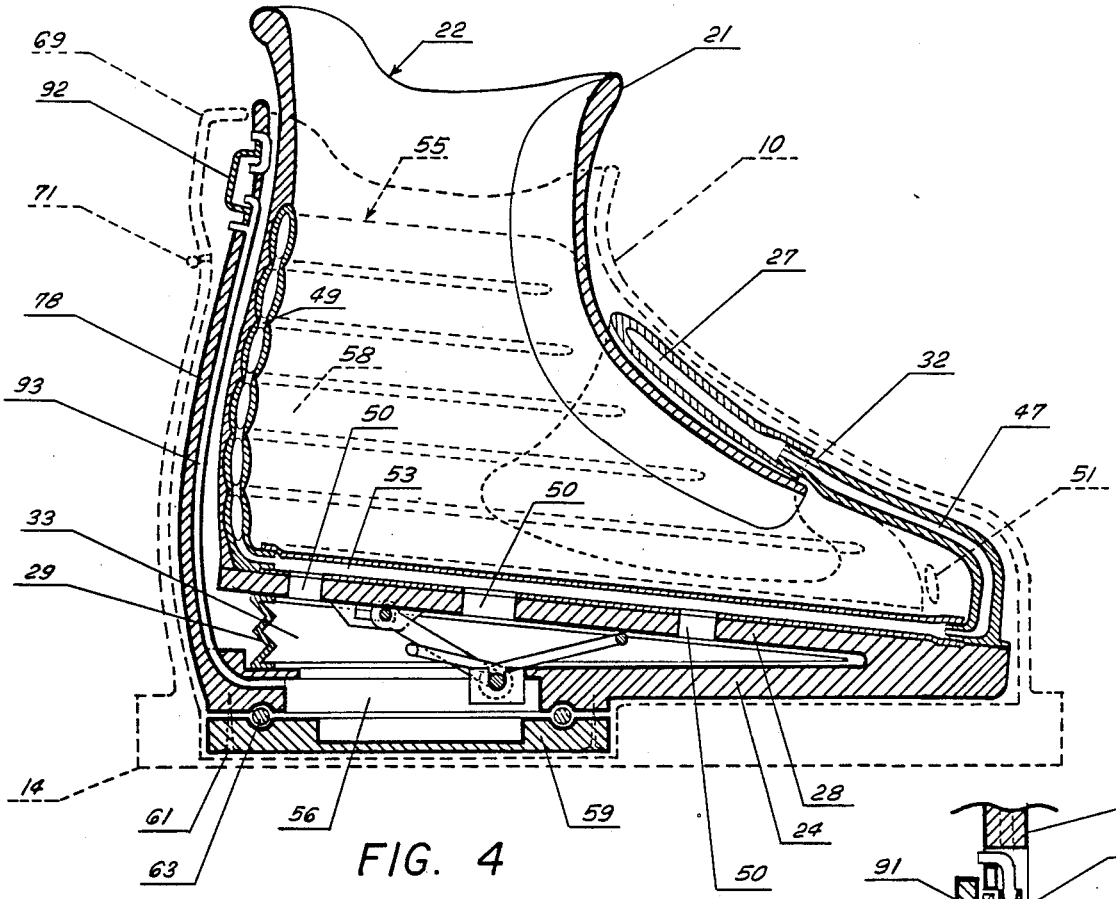
FIGS. 4 and 5 are elevational section views of the ski boot illustrating an air cushion between the inner shoe and boot.
Figure 5:
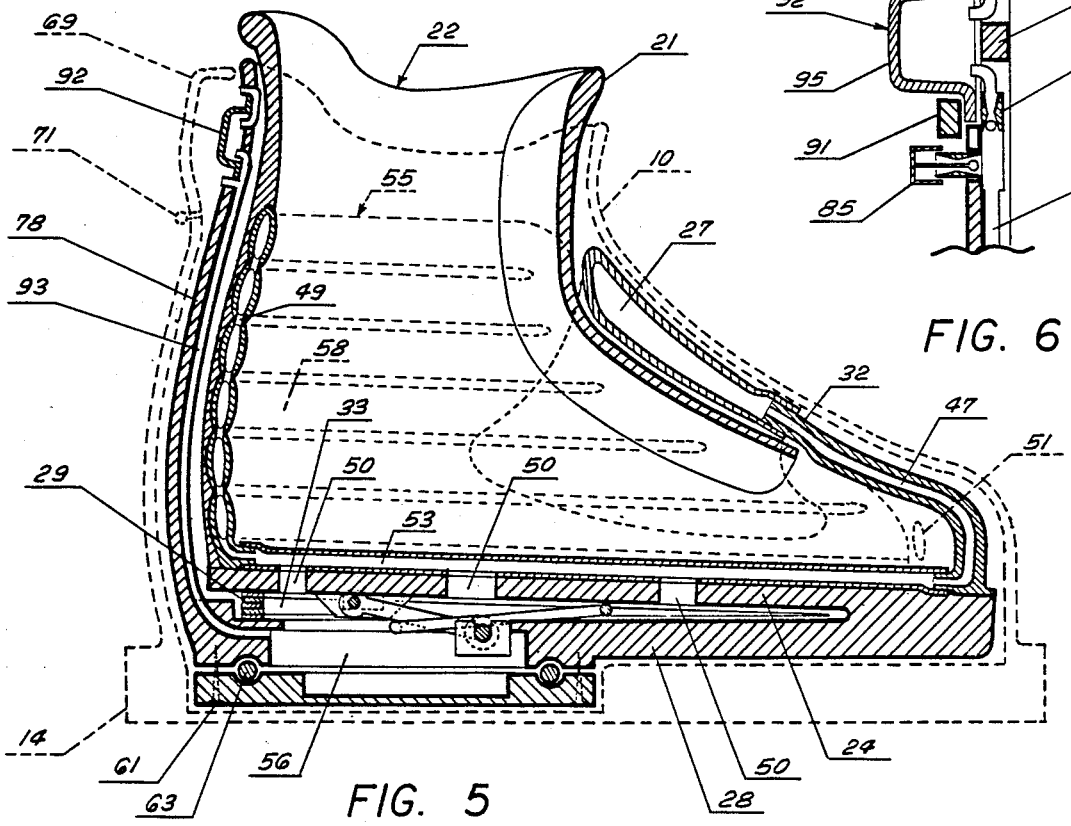

Referring now to FIGS. 4 and 5, the foot warmer elements are not illustrated, to provide a simplified illustration of the function and operation of the air pressurization and circulation system. Also, the air circulation system shown in these FIGS. 4 and 5, can be used without the heating means, for benefits of comfort and shock absorbency. As previously mentioned, the air bag 27 forms a confined chamber which is in open communication with the tubes 53 and 58 of the lining 55. The latter are in open communication with the cavity 33, that is located between the inner sole 24 and lower sole 28, and with the tubes 58 on the inside surfaces of the uppers of the shoe. An air pump 92 is provided to permit the wearer to adjust the air pressure within the cavity 33, inflatable lining 55, and air bag 27. The pump applies air though flexible conduit 93 directly into the cavity 33.

The air bag 27 functions to maintain a sense and feeling of tight lacing or binding of the ski boot, while permitting a limited freedom of movement of the inner shoe within the boot. In FIG. 4, the inner sole 24 is shown in its most elevated position, with the heel of the inner sole elevated above the lower sole 28. The air bag 27 is compressed in this position, exhausting its air into the cavity 33. When the wearer's weight is applied to the heel, the inner sole 24 moves downwardly, forcing the air from cavity 33 into the air bag 27. Thus, although the instep of the inner shoe 22 moves away from boot 10 during walking and skiing activities, the wearer still senses a tightness of fit, as the air bag 27 maintains pressure on the instep. The normal movement of the wearer's foot within the shoe creates a forced circulation of air through the lining 55 and the cavity 33 which is heated (as described hereafter). This forced circulation increases the heat transfer throughout the shoe.

Figure 6:
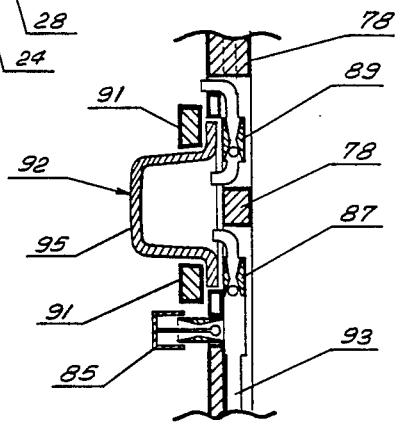
FIG. 6 is an enlarged sectional view of the air pump used with the boot of FIGS. 4 and 5.

Referring now to FIG. 6, the air pump 92 comprises a flexible bulb 95 which is sealed in the assembly by ring 91. The bulb 95 receives air through the inlet valve 89 and discharges the air under pressure through outlet valve 87. The air system is also provided with a relief valve 85, which when depressed will relieve the air pressure within the air bag system.

Figure 7:
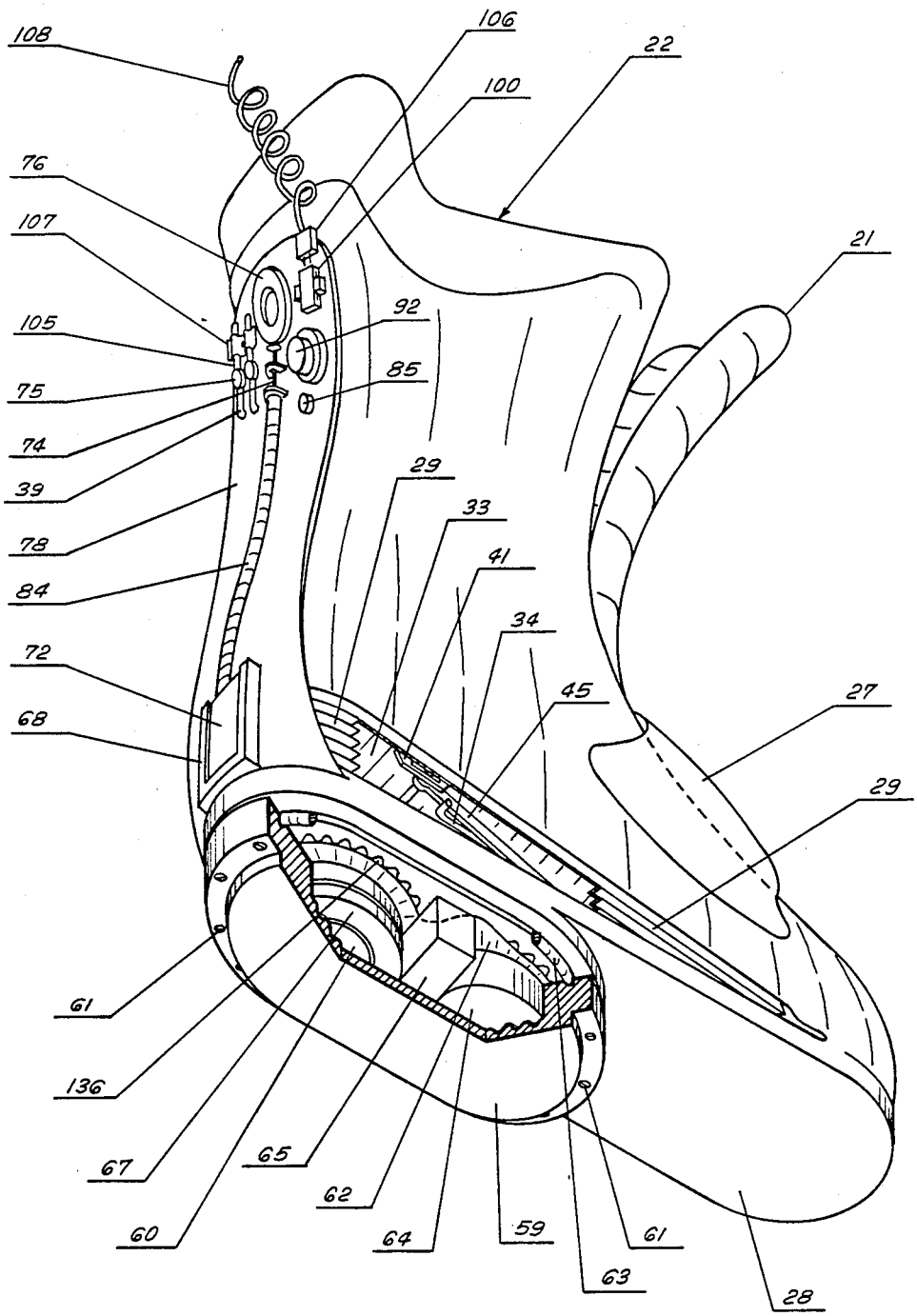
FIG. 7 is a perspective view of the inner shoe in partial cut away section.

Referring now to FIG. 7, a perspective view of the rear end under surface of the inner shoe 22 is illustrated. The lower sole 28 has integrally molded compartment 56 on its undersurface at the heel and instep to receive the aforementioned major components of the electrical generator mechanism. As previously mentioned, the lower sole 28 also distally supports the brake compartment 68 which is formed as an integrally molded pocket at its heel end with a removable vertical plate 72 that is slidably received in the pocket to protect the moveable elements of the brake to prevent interference with the inner surfaces of the outer boot 10 that would obstruct free movement of these elements. The electrical storage battery 65 is mounted between the transducer 60 and the electrical generator 64. A radio frequency transmitter 67 in the form of an annular ring is mounted at the base of the transducer 60. The entire compartment 56 is closed with cover 59 which is secured with screws 61, and sealed with O-ring 63.

Figure 8:
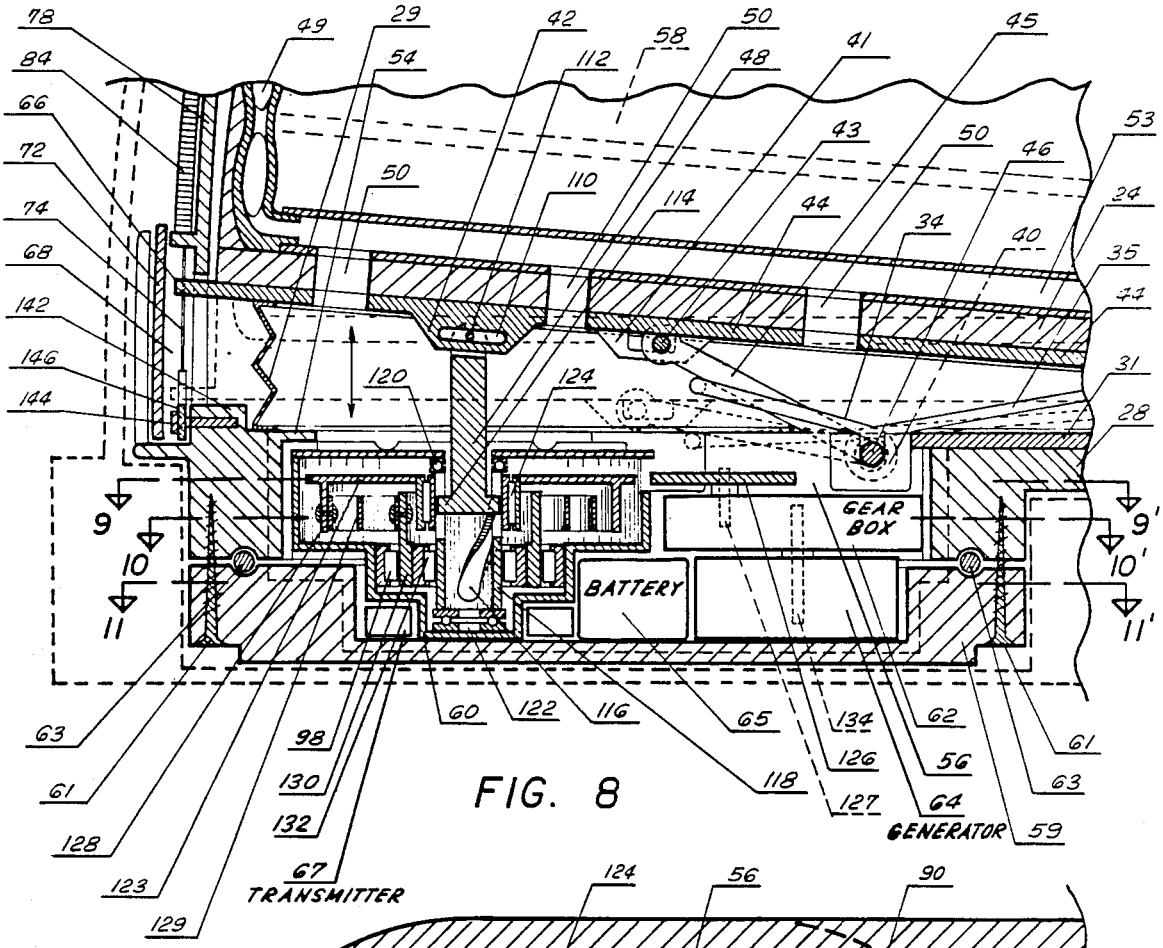
FIG. 8 is an elevational sectional view along line 8-8' of FIG. 9.

Referring now to FIG. 8, there is illustrated an elevational sectional view through the heel and instep of the inner shoe 22, depicting the major components of the footwarmer mechanism. The inner sole 24 has an integrally molded dependent bracket 42 on its undersurface having a longitudinal slot 110 which receives pin 112 that extends through the upper end of the vertical post 48. The large compartment 56 is partially covered by plate 54 which retains the transducer 60. The lower end of the post has lateral pins 114 which project into a helical groove 116 in the wall of sleeve 118 which is mounted for free rotational movement between upper bearing 120 and lower thrust bearing 122. Flywheel 123 is mounted and rotationally received on sleeve 118 with a needle roller bearing 124 to provide free rotational movement.

The outer periphery of the flywheel 123 has gear teeth 125 which engage the driven gear 126 that is fixedly mounted on the shaft 127 of the gear box 62. The flywheel 123 has a downwardly dependent annular skirt 128 within which is nested a coiled helical spring 129 that provides a resilient mechanical linkage to the inner sleeve 130 which is also rotationally mounted on the drive sleeve 118. The drive sleeve 118 is connected to the inner sleeve 130 by rotational clutch mechanisms 98 and 132 which provide unidirectional rotation of the inner sleeve 130.

The remainder of the electrical generator mechanism is illustrated in block diagram and constitutes the gear box 62 that is mounted above the electrical generator 64 and connected thereto by generator shaft 134 which extends upwardly into a driven relationship within the gear box. Battery 65 is also mounted within compartment 56, and the radio frequency transmitter 67 is mounted at the base of the mechanical transducer 60.

The spring mechanism is also shown as including the torsion coils of spring 40 which are received within laterally disposed compartments 90 and the forwardly projecting spring arms 35 and rearwardly projecting spring arms 34. Brackets 41 are mounted at each side on the undersurface of the plate 44 of the inner sole 24 and shaft 46 extends between and is slidably received in the slots of these brackets. A pivot arm 45 is positioned at each side of the assembly, linking shaft 43 to shaft 46 which is received in the coils of spring 40. The two side mounted pivot arms 45 and the shaft 43 thereby form an inverted U-shaped hinged support (see also FIG. 7). The rear ends of spring arms 34 have outwardly bent ends (best illustrated in FIG. 7) which are received beneath the lower edges of arms 45, to resiliently bias these arms upwardly. The forwardly projecting arms 35 also have an integral lateral leg 36, thereby also forming an inverted U-shaped support at the mid-portion of the plate 24 (see FIG. 2). As previously mentioned, this support structure prevents any side to side tilting of plate 24.

Figure 9:
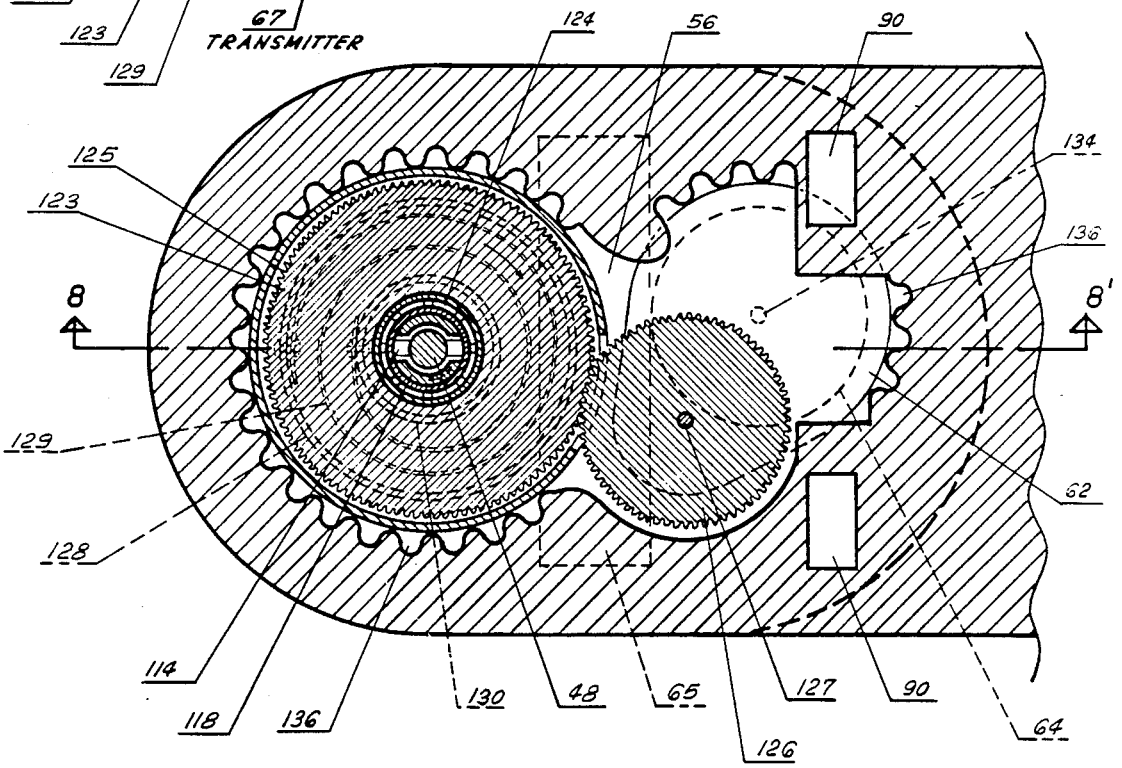
FIG. 9 is a sectional view along line 9-9' of FIG. 8.

FIG. 9 illustrates the aforementioned elements of the footwarmer mechanism along lines 9-9' of FIG. 8. As there illustrated, the lower sole 28 has an integrally molded compartment 56 which is formed with a vertically channeled wall 136 surrounding the mechanical transducer 60, the gear box 62 and the electrical generator 64. The channels in this wall are desirable as they permit air circulation over and about the mechanical and electrical elements, thereby cooling these elements and recovering heat for transfer to the wearer's foot.

At the instep area, the outer sole 28 has two pockets 90 which are laterally disposed and which receive the helical windings of the torsion springs 40 that provide the resilient upward bias to the arms 34 and 35 that urge the inner sole 24 in an upward direction.

Referring to FIG. 8, the lower sole 28 has a raised integral block 142 at its heel end, which receives a machine screw fastener 144 for pivotal attachment of the brake latch, described in greater detail with reference to FIGS. 12–15. The lower sole 28 terminates with a brake pocket 68 formed on its rear surface and covered by vertical plate 72.

Figure 10:
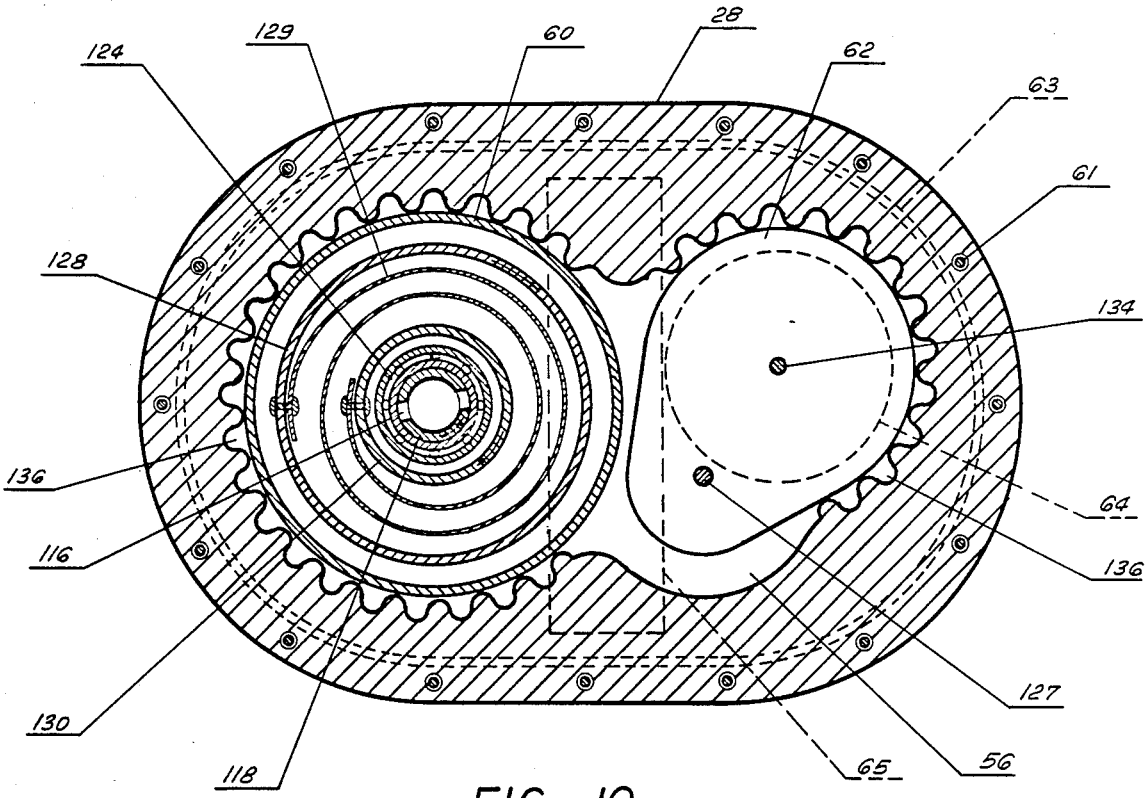
FIG. 10 is a view along line 10-10' of FIG. 8.

Referring now to FIG. 10, there is illustrated a view of the mechanical transducer 60 taken along lines 10-10' of FIG. 8. As there illustrated, the inner sleeve 130 is illustrated in a resilient interconnection to the annular skirt 128 of the flywheel 123 by the coiled helical spring 129. This resilient interconnection provides a shock absorbency to the mechanical transducer 60 so that in the event that the heel is driven downwardly in an abrupt movement as experienced during jumping, the mechanical shock of this movement is absorbed by the spring and is not directly transmitted to the flywheel 123. The view of FIG. 10 illustrates the needle roller bearings 124 which provide the free rotational mounting of the flywheel 123 on the drive sleeve 118 and also illustrates the helical groove 116 in the sidewall of the drive sleeve 118. The gear box 62, which is a commercially available unit, is shown in solid view. The preferred embodiment uses a gearbox with a gear ratio from 200/1 to 500/1; preferably with a 300/1 gear ratio. The selection of the gear ratio depends somewhat on the weight and anticipated activities of the wearer. The gearbox is permanently lubricated is driven by the mechanical transducer, thereby multiplying the rotational speed of the unit. Motors, or generators can be clipped to the housing for easy assembly, permitting simple and quick interchange of generator or gearbox, or both.

Figure 11:
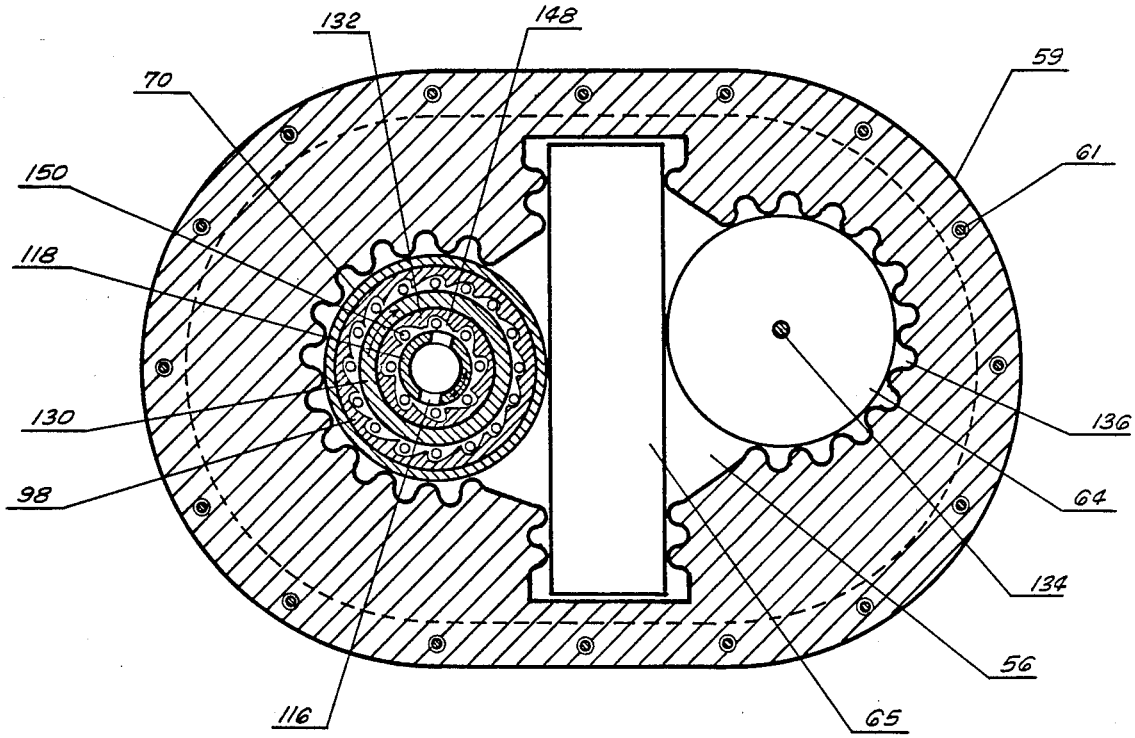
FIG. 11 is a view along line 11-11' of FIG. 8.

Referring now to FIG. 11 there is illustrated a sectional view along lines 11-11' of FIG. 8, through the escapement clutch mechanism 132 of the mechanical transducer 60. This clutch mechanism 132 is a conventional unit which is pressed into inner sleeve 130, and which functions by transmitting unidirectional rotational force from the rotational movements of the drive sleeve 118. The preferred embodiment uses a Torrington drawn cup roller clutch. Since the drive sleeve 118 is keyed to the vertical post 48 which undergoes reciprocal up and down movement, the drive sleeve 118 will rotate in opposite rotational directions. Only the clockwise rotational movement of the drive sleeve 118, however, will be transmitted to the inner sleeve 130 which surrounds the lower end of the drive sleeve 118 as the clutch mechanism effectively transmits only clockwise rotational movement. This occurs since the cam surfaces 148 in the clutch mechanism 132 are only engaged by rollers 150 when they become wedged against the inclined cam surfaces 148. The opposite or counterclockwise rotation as viewed in FIG. 11, is effective to move the rollers 150 out of their wedged relationship, freeing the drive sleeve 118 for rotation without movement of the inner sleeve 130.

A second escapement clutch mechanism 98 is also provided and is frictionally seated in wall 70 of the transducer 60 to prevent rotation of the inner sleeve 130 in a counterclockwise direction, as viewed in FIG. 11. The illustrated clutch mechanisms are preferred for compactness and ease of operation. It is apparent, however, that they could readily be substituted by other conventional clutch mechanisms, e.g., those having ratchet and pawl elements.

The electrical generator mechanism is a conventional electrical direct current motor which is capable of operation as a generator. A wide variety of electrical motors can be used for this purpose; generally motors which can generate from 1 to 10 watts at speeds of from 4000 to 12000 revolutions per minute are quite suitable. The generator can be a dc, or ac, generator. An example of a useful generator is a dc motor having a 12 pole ferrite magnet. This motor generates approximately 2 watts at 7000 rpm. As this is a conventional unit, it is simply shown in the sectional view as a solid body. The electrical storage battery 65 is mounted in compartment 56 and is a conventional rechargeable dry cell, e.g., a conventional rechargeable battery, e.g., a nine-volt, nickel-cadmium battery. The battery is useful to store energy from the generator and distribute a steady voltage, even during periods when the wearer is not active.

FIG. 12 shows the preferred construction of vertical tab 78. Preferably this tab is formed with a plurality of vertical channels 37 coextensive its length, thereby forming vertical recesses which can receive the tubing 93 for the air system, or flexible conduits such as 84 (shown in FIGS. 1, 2 and 7) and/or flexible conduits 38 and 39 (shown in FIGS. 13, 14 and 15).

Referring now to FIGS. 12 through 15, the brake mechanism will be described in greater detail. As previously described, the lower sole 28 supports, at its heel end, the vertical tab 78 which has a vertical slot 152 to receive the tab 66 at the end of the inner sole 24. The length of this vertical slot 152 provides the limits of travel for the heel and post 48 (not shown). The brake mechanism includes a latch 146 that is pivotally secured to lock onto the tab 66 on the heel of the inner sole 24. Latch 146 has a spring arm 154 and an actuator arm 156 with a latching finger 160. The spring 162 resiliently biases the mechanism into an unlatched position, which is shown by the solid lines. When the cable 74 is pulled upwardly, the latch finger 160 is rotated into engagement with tab 66, thereby locking the tab 66 and its dependent inner sole 24 in the depressed position, all as shown by the phantom lines in FIGS. 12 and 14.

Figure 15:
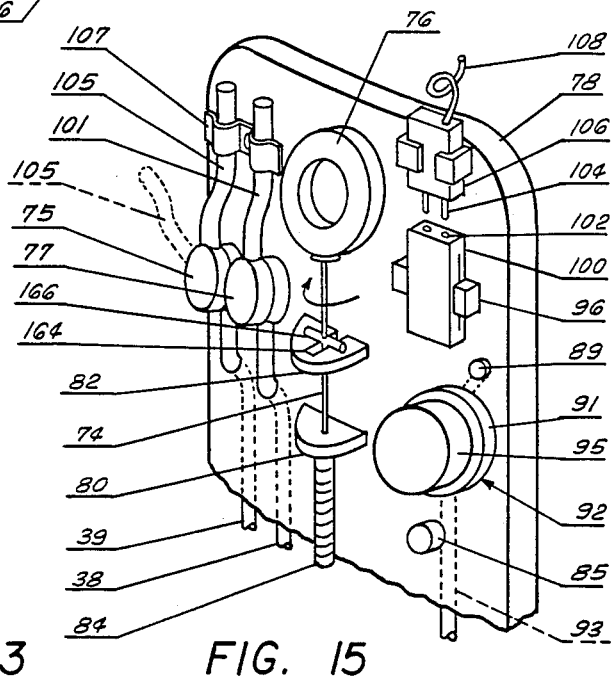
FIG. 15 is a view of the upper end of the rear tab of the inner shoe.

As shown in FIGS. 14 and 15, the cable 74 extends upwardly through a mounting bracket 80 and a locking bracket 82 which has a single elongated slot 164. A pin 166 is transversely permanently secured to the cable 74 so that when it is pulled through the slot 164 and rotated, as shown in FIG. 15, it will lock the cable 74 against retraction, thereby securing the latch finger 160 in its detenting position against the bias of the spring 162.

As previously mentioned, the mechanism also includes a connector block 100 having a manual switch 96 to permit disconnecting the electrical generator from the conductors supplying electrical energy to the serpentine windings in the toe of the shoe. The switch also has switch levers which can be opened or closed in circuit to the windings 94 and/or to the receptacles 102 of connector block 100 to permit the application of the electrical power to shoe heater, or to the receptacles 102, respectively. As previously mentioned, receptacles 102 removably receive the connector plug 1.06 attached to conductor 108 that extends to heating elements in other wearing apparel such as mittens, pants, jackets and the like. The connector plug can also be used to attach an emergency light. In this manner, the electrical power can be switched to either or both the toe heater and heaters in other wearing apparel.

As previously mentioned, the shoe can also be used to pump warm air from the compartment 56 to an inflated suit, or to a suit lined with an inflated lining similar to lining 55. For this purpose, flexible conduits 38 and 39 (see FIG. 15) are provided. These conduits are provided with check valves 115 and 117 (see FIG. 14) so that conduit 39 supplies air from the shoe to the suit, and conduit 38 returns air from the suit to the shoe. The conduits extend along channels on the inside surface of tab 78 (see FIG. 13) and exit at the top of the tab, terminating in conduit connectors 75 and 77. Blind extensions 101 and 105 are provided to close the conduits when not in use. These can be removed from the connectors 75 and 77, by pulling the end of the blind extension such as 105 from its holder 107, and rotating it to the position shown in phantom lines of FIG. 15. Similar flexible conduits which extend from the inflated suit or suit lining and which have connector fittings are placed in the connectors 75 and 77 after removal of the blind extensions 101 and 105. In this manner, air which has been warmed by passage through the shoe can be pumped to an inflated suit or inflated lining of a suit to warm the suit.

Figure 16:
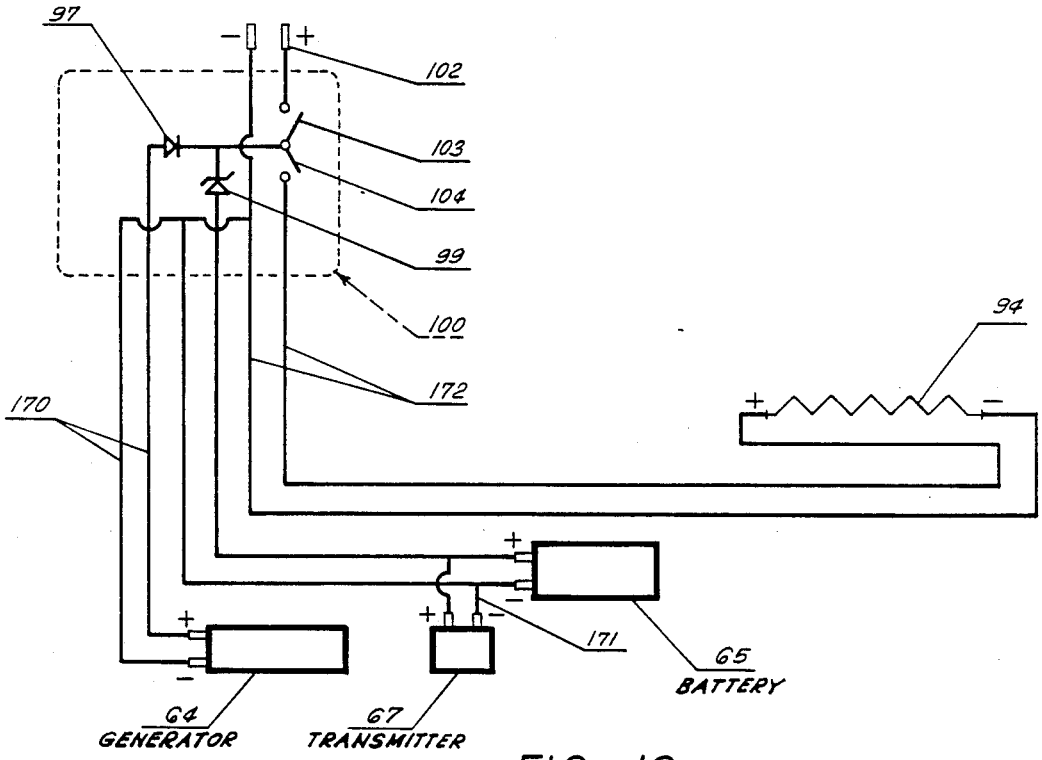
FIG. 16 is an electrical schematic of the foot warmer circuits.

FIG. 16 illustrates an electrical schematic of the circuit in which the power developed from the electrical generator 64 is transmitted by the power conductors 170 to the connector block 100 and from there is transmitted through switch lever 104 to conductors 172 that extend along the lower sole 28 to electrical contact with the serpentine windings 94 in the toe of the shoe. The switch also includes lever 103 which is in circuit to receptacles 102 to provide electrical power to those receptacles. Switch levers 103 and 104 are shown in open positions. The rechargeable electrical storage battery 65 is in circuit to the electrical generator through diode 97 and Zener diode 99, which, respectively, prevent the battery from driving the electrical generator as a motor, and prevent overcharging of the battery. The radio frequency transmitter is a low voltage and low power transmitter having a limited broadcast range. The transmitter can be continuously in circuit to the power supply, as illustrated. Alternatively, a manual switch can be placed in conductor 171 to permit disabling of the transmitter when it is not needed. The transmitter is intended for use as an emergency locator transmitter, to locate a skier or hiker who may be injured, or trapped by a rock or snow slide.

Figure 17:
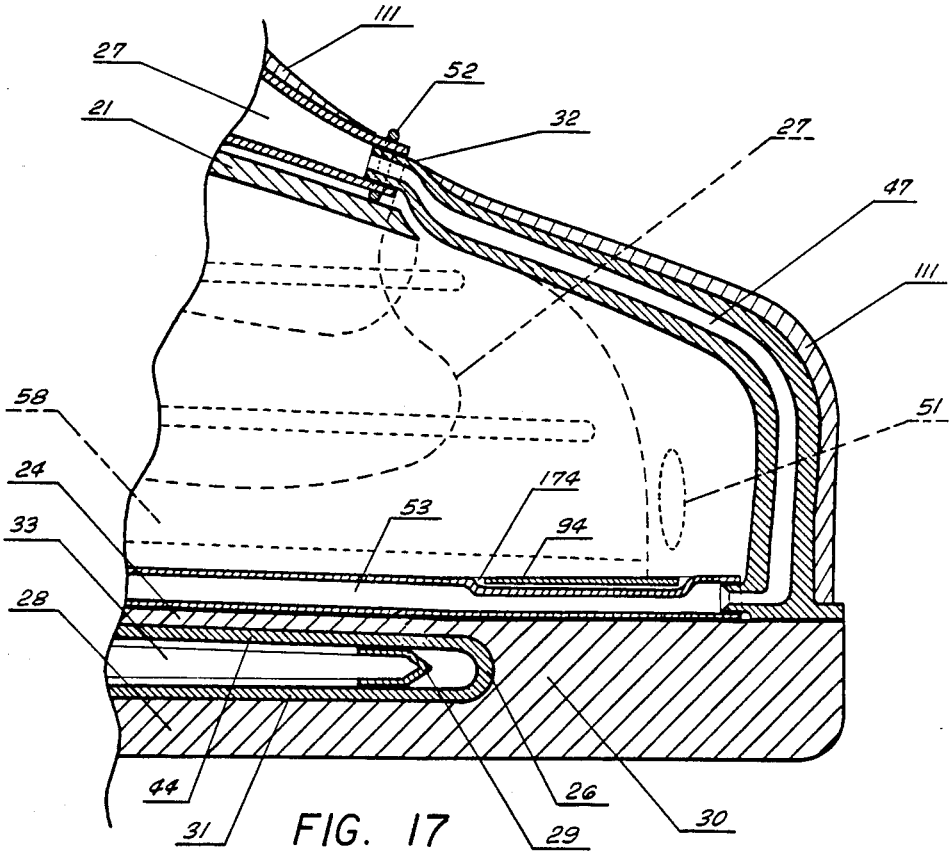
FIG. 17 is an elevational sectional view of the toe of the inner shoe.

FIG. 17 illustrates the toe of the ski boot; and illustrates the integral hinge 30 between the lower sole 28 and inner sole 24 and the air tubes 53 on sole 24. The tubing connectors 32 to the air bag 27 are shown, and the similar connectors 51 between the lowermost tube 58 in the side of the inflatable lining 55 is also shown in phantom lines. Preferably, the connectors are secured with a retaining clamp ring 52, as shown in FIG. 17. If desired, the clamp ring can be eliminated by cementing or bonding the connecting tubing. This view also illustrates the electrical heating windings 94 mounted within a pocket 174 molded into the toe end of the inner sole 24. Electrical conductors such as Mylar flex circuits, in which copper foil conductors are molded within a Mylar film, can be used to connect the windings 94 to the battery 65 and generator 64. These Mylar flex circuit conductors could be molded directly into the plastic of the inner shoe. The entire inner shoe 22 is preferably covered with a thermally insulating material 111 such as a foamed polyurethane plastic.

Figure 18:
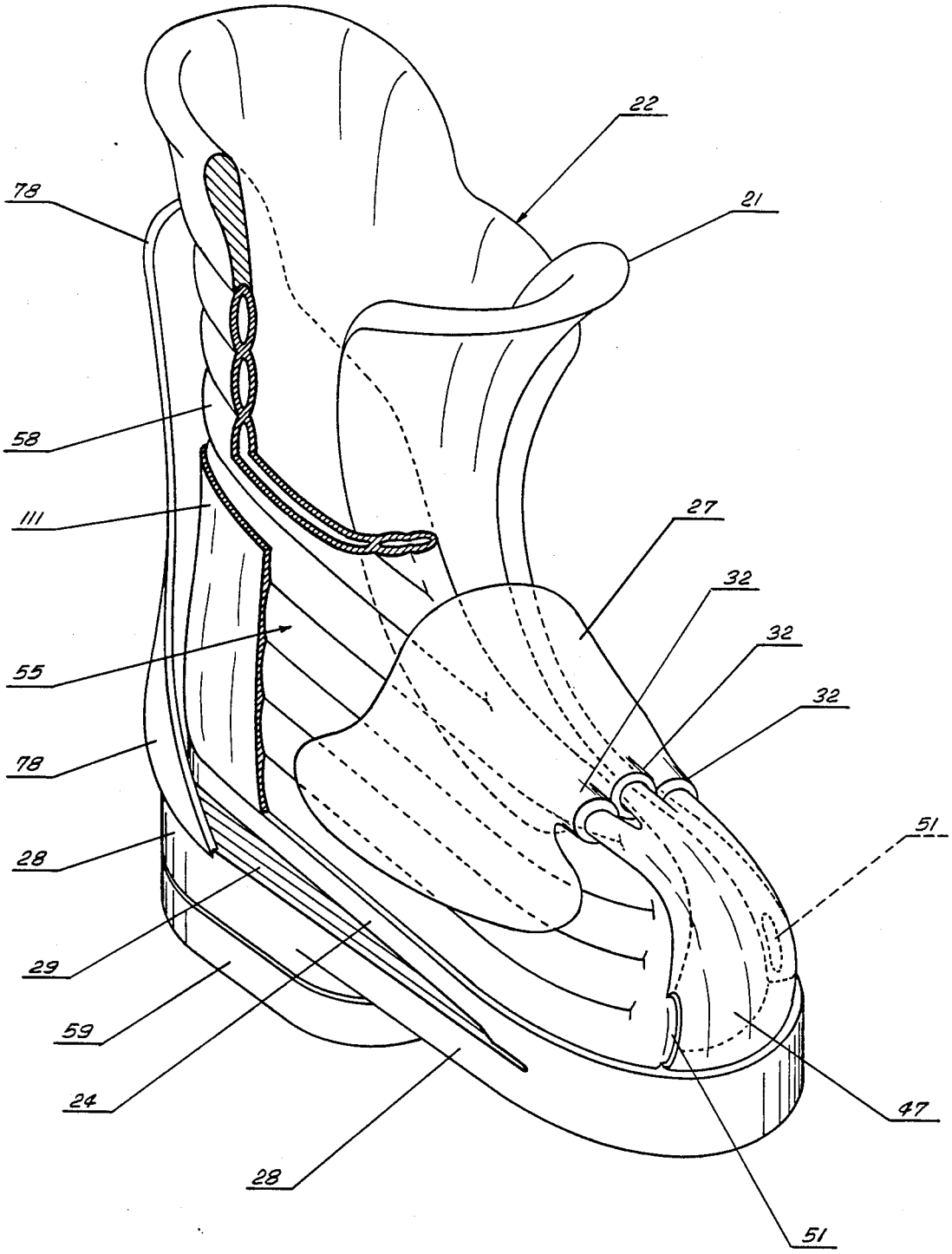
FIG. 18 is a front perspective view, in partial cross-section, of the inner shoe.

FIG. 18 is a perspective view with an upper corner of the inflatable liner 55 in sectional view. The shoe has a conventional tongue .21 and an upper anklet portion. As shown, the toe of the shoe has an air collector 47 which receives air from the inflatable liner 55 and communicates with the air bag 27 through connector 32. Preferably, the entire inflatable liner 55 is covered with the insulating material 111. Membrane 29 extends between the upper sole 24 and lower sole 28. If desired, the vertical tab 78 can be extended forward along each side of the shoe, thereby forming a protective cover over the inflatable lining 55. The inside surface of this tab could be coated with a low frictional characteristic material such as Teflon, or could even support mechanical rollers to reduce the frictional contact between the inside surfaces of the tab 78 and the lining 55, or insulating material 111.

The invention is readily adaptable to the conventional molded plastics ski boots which are presently marketed. The electrical generating elements are mounted within compartments which are sealed to the atmosphere. The elements are, however, readily accessible by removal of the cover plate 59, so that the transducer, gearbox, or generator can be removed and replaced. This permits adjustment of the electrical generator mechanism to the individual, and to the severity of climatic conditions which may be experienced. It also provides for easy repair and replacement of worn or broken mechanical parts.

The invention has been described with reference to the illustrated and presently preferred embodiment. It is not intended that the invention be unduly limited by this disclosure of the presently preferred embodiment. Instead, it is intended that the invention be defined, by the means, and their obvious equivalents, set forth in the following claims:

What is claimed is:

1. An air pressurization and circulation system for an inner shoe having an upper portion including a cover over an instep area, a heel with an open compartment and an outer sole and having an inner sole mounted within said shoe for relative vertical movement therein in response to foot movements during normal walking activities of a wearer of the shoe, the improvement, of a closed and pressured air circulation system comprising:

a. an air bag extending about and over the instep area of said inner shoe;

b. membrane means secured between said inner and outer soles of said inner shoe and forming a sealed cavity between said soles;

c. air circulation channels extending into sealed communication between said sealed cavity and said air bag; whereby said relative vertical movement of said outer and inner soles creates a forced circulation of air between said air bag and said sealed cavity; and d. air pump means connected to discharge air into said closed air circulation system and thereby permit pressurization of said system.

2. The improvement of claim 1 including a resilient spring mounted within said shoe, beneath said inner sole to bias said inner sole upwardly against the foot of the wearer of the shoe.

3. The improvement of claim 1 wherein said air pump means is mounted on an external surface of said shoe with an air hose communicating from said air pump means to said sealed cavity.

4. The improvement of claim 3 including a relief valve mounted in said air hose with a release button to permit adjustable release of air pressure within said air bag and sealed cavity.

5. The improvement of claim 1 wherein said membrane means is a flexible membrane which extends between peripheral edges of said inner and outer soles of said inner shoe.

6. The improvement of claim 1 including at least one flexible conduit extending from said sealed cavity to a connector location externally of said shoe, to permit said sealed cavity to be connected to external inflatable members.

7. The improvement of claim 6 including a pair of said flexible conduits, each having an oppositely connected check valve to permit one of said flexible conduits to function as a supply of air from said shoe and the other as a return of air to said shoe, whereby said shoe functions to pump air through said conduits.

8. The improvement of claim 7 wherein said boot is a ski booted with a molded plastic outer shell having an upper portion with a top which surrounds the leg of the wearer, and a molded inner shoe.

9. The improvement of claim 8 wherein said outer sole supports a vertical tab with an inside surface at its heel which extends upwardly to the top of said shell.

10. The improvement of claim 9 where in said flexible conduits extend from said sealed cavity, along the inside surface of said tab to said connector location on said tab at the top of said shell.

11. The improvement of claim 10 including a mechanical translator located in said open compartment of said heel and mechanically linked to the vertical movement of said inner sole and an electrical generation means seated in said compartment within said heel and including a gearbox and a mechanically interconnected electrical generator and electrical heating means within said shoe in circuit to said electrical generator.

12. The improvement of claim 11 wherein the side walls of said open compartment are lined with vertical grooves to form channels permitting the circulation of air through and about said open compartment and over said mechanical translator and electrical generator.

13. The improvement of claim 11 including:

a. a flywheel mounted for rotational movement on a vertical axis in the heel of said shoe;

b. a sleeve also mounted in the heel of said shoe coaxial with said flywheel; and c. a resilient helical coil spring with its inner end secured to said sleeve and its outer end secured to said flywheel, whereby rotational movement of said sleeve is resiliently transmitted to said flywheel, and said spring absorbs shocks from impacts applied to said sleeve by rapid and forceful movements of said inner sole.

14. The improvement of claim 13 wherein said sleeve has a spiral track along its wall and said inner sole supports a vertical post with an orthogonal pin which is received within said sleeve with an end of said pin projecting into said spiral track, whereby vertical movements of said inner sole are translated to rotational movements of said sleeve.

15. The improvement of claim 14 including a resilient spring mounted within said shoe, beneath said inner sole to bias said inner sole upwardly against the foot of the wearer of the shoe.

16. The improvement of claim 15 wherein said resilient spring comprises a U-shaped spring structure with laterally disposed arms pivotally mounted on said outer sole and received in slots of brackets laterally disposed on an undersurface of said inner sole.

17. The improvement of claim 11 wherein said outer sole supports a vertical tab at its heel which extends upwardly to the top of said shell.

18. The improvement of claim 17 including a brake compartment in a lower end of said vertical tab.

19. The improvement of claim 18 including a vertical slot in said vertical tab opening into said brake compartment, and including a distal tab on of said inner sole which projects into said brake compartment.

20. The improvement of claim 19 including a latch within said brake compartment and pivotally mounted on said vertical tab between a recessed position and an advanced position engaging said distal tab.

21. The improvement of claim 20 including a cable extending along from the upper end of said vertical tab to said brake compartment where it is fixedly secured to said latch, thereby serving as a remote cable actuator for said latch.

22. The improvement of claim 20 including a cable extending from the top of said shell along said vertical tab to said brake compartment where it is secured to said brake means, thereby serving as a remote cable actuator for said latch.

23. The improvement of claim 17 including a switch mounted on an upper end of said vertical tab, and first electrical conductor means extending from said electrical generator to said switch, and an electrical resistance heater in a toe of said boot with second electrical conductor means extending from said switch to said electrical resistance heater.

24. The improvement of claim 23 including an electrical connector block with electrical receptacles to receive a removable electrical plug and third electrical conductor means extending from said switch to said electrical receptacles.

* * * * *

UNITED STATES PATENT AND TRADEMARK OFFICE

CERTIFICATE OF CORRECTION

PATENT NO. : 4,845,338

DATED : July 4, 1989

INVENTOR(S) : Nikola Lakic

It is certified that error appears in the above-identified patent and that said Letters Patent is hereby corrected as shown below:

Claim 8, Column 12, Line 2, change "booted" to --boot--

Claim 19, Column 12, line 60, after "tab on", delete "of"

Signed and Sealed this

Twenty-fourth Day of April, 1990

*Attest:*

HARRY F. MANBECK, JR.

*Attesting Officer*

*Commissioner of Patents and Trademarks*